United States Patent [19]

Muller-Girard et al.

[11] Patent Number: 4,527,217

[45] Date of Patent: Jul. 2, 1985

[54] INSTRUMENT PROTECTIVE DEVICE

[75] Inventors: Otto Muller-Girard, Rochester; Philip P. Schulp, Pittsford, both of N.Y.

[73] Assignee: Transmation, Inc., Rochester, N.Y.

[21] Appl. No.: 654,519

[22] Filed: Sep. 25, 1984

Related U.S. Application Data

[63] Continuation of Ser. No. 469,313, Feb. 24, 1983, abandoned.

[51] Int. Cl.[3] ..... H01R 13/44

[52] U.S. Cl. ..... 361/179; 361/1; 361/343; 335/205; 200/51 R; 339/12 R; 339/147 P

[58] Field of Search ..... 361/1, 58, 180, 179, 361/376, 346, 344, 343; 335/205, 206, 151, 152, 153, 154; 200/51 R, 51 LM, 51.03, 50 B, 61.58 R; 339/12 R, 12 L, 147 P

[56] References Cited

U.S. PATENT DOCUMENTS

| | | | |
|---|---|---|---|
| 3,637,986 | 1/1972 | Laing | 335/205 X |
| 3,749,982 | 7/1973 | Derdzinski et al. | 335/205 X |
| 4,156,265 | 5/1979 | Rose | 361/179 |
| 4,349,800 | 9/1982 | Shimoya | 335/205 X |
| 4,371,856 | 2/1983 | Holce et al. | 200/51 R X |

*Primary Examiner*—Patrick R. Salce
*Attorney, Agent, or Firm*—Jay M. Cantor

[57] ABSTRACT

The disclosure generally relates to a protective device for an electronic instrument wherein input and output lines to and from the instrument are always isolated from calibration input and output terminals. This is accomplished by placing reed switches on or closely adjacent the non-magnetic instrument front panel, the switches being arranged to connect one of the input lines and terminals to the instrument circuitry while disconnecting the others therefrom, this being accomplished under control of a magnet placed adjacent the switches during a calibration procedure. The switches are further arranged to short circuit the output test terminals in the unenergized switch state to prevent insertion of unwanted signal current or voltage in that state. A magnetic key extension plug inserted into the terminals is disclosed to accomplish this switching action, the plug including a magnetic and extension terminals for receiving external leads and for insertion into the calibration inputs and/or outputs, the magnet controlling the reed switches as described above.

9 Claims, 5 Drawing Figures

Fig. 4
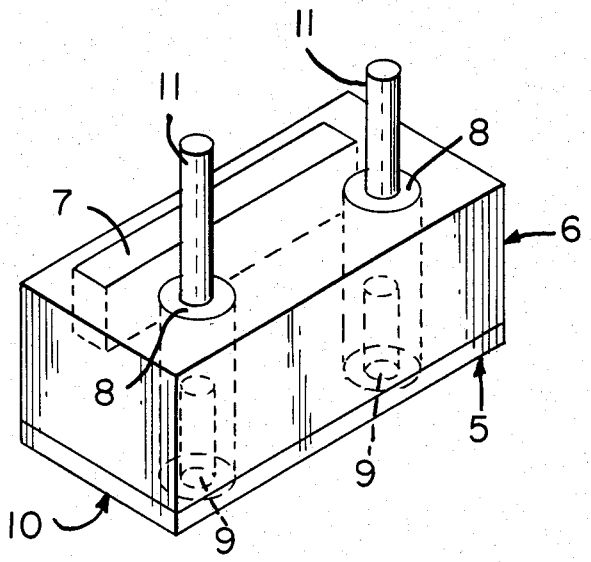
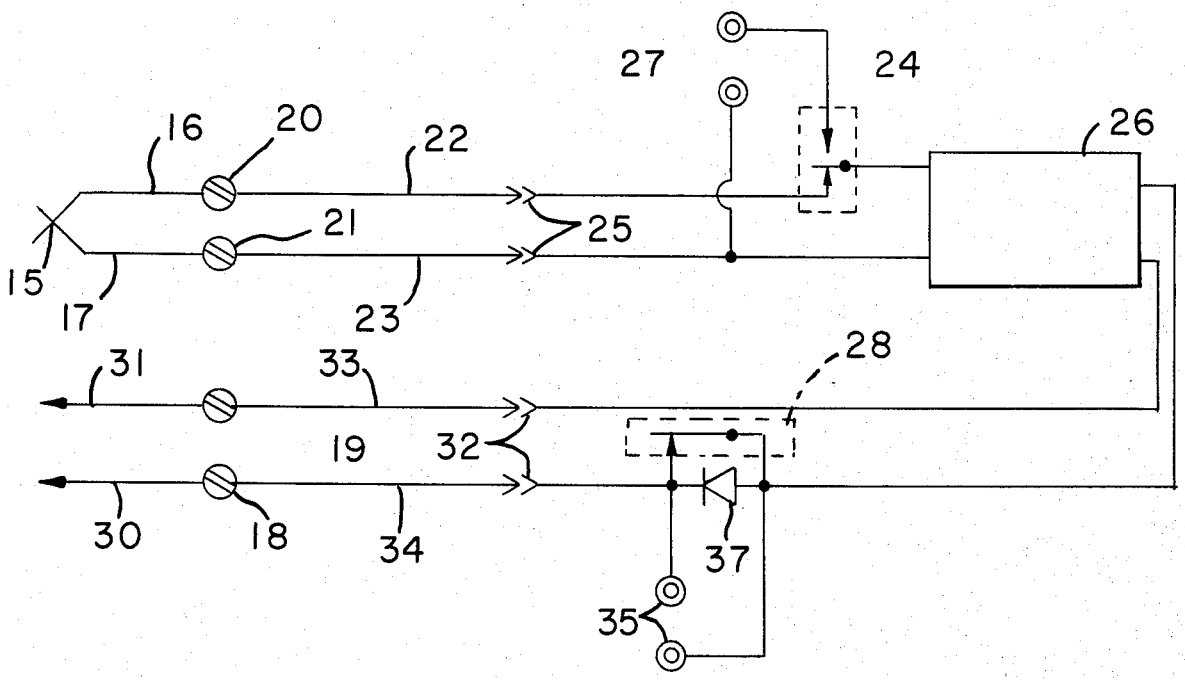
Fig. 5

INSTRUMENT PROTECTIVE DEVICE

This application is a continuation of application Ser. No. 469,313, filed Feb. 24, 1983; now abandoned.

BACKGROUND OF THE INVENTION

1. Field of the Invention

This invention relates to a protective device and circuitry for use in conjunction with input and output test and calibration terminals of electronic instruments.

2. Description of the Prior Art

Electronic instruments are widely used for purposes of translating physical variables to be operated upon into electrical signals and transmitting these electrical signals over a distance to an electrical device of known type. Such instruments are common in the chemical, petroleum, metals and mining industry to name but a few such industries. These transmitted electrical signals are normally used to indicate display, record and/or monitor, in conjunction with additional equipment, the physical quantities represented by the transmitted electrical signals. Often, the input signals to the many electrical instruments are initially electrical in nature such as those derived from thermocouples, resistance temperature detectors (RTDs) and other physical variable transducers. The reliability of performance and faithfulness of signal acquisition and transmission is of great importance and is enhanced by the rigid mounting of the instruments to substantial support structures. It has also been the practice to secure wires from external devices to the electronic instrument by means of screw terminals to maximize the integrity of the connection and to minimize alteration of the signal being received at the securing site.

Furthermore, the accuracy of the electronic instruments often comes into question and, in this situation, it is desirable to calibrate the instrument for accuracy and make adjustments, if necessary, to ensure maximum accuracy. When such calibration takes place in instruments of the type described above, because of the solid mounting of the instruments and the screw attachment of the wires, the removing and later remounting of an instrument is a time-consuming matter. The invention to be described hereinbelow relates to this problem wherein screw attached wires need not be disattached for calibration purposes. Also, access to the instrument is provided without the requirement of removing the instrument from its rigid mounting support.

SUMMARY OF THE INVENTION

The disclosure relates to an instrument protection device for use in connection with electronic instruments and particularly electronic display recording and monitor devices which, upon insertion of the device into predesigned input and/or output terminals of the instrument, causes switches within the instrument to disconnect predetermined input and/or output leads within the instrument from the instrument circuitry and to connect the input and/or output test terminals, required for calibration purposes, to the electronic instrument circuitry for purposes of testing. The above is accomplished by providing a pair of magnetic reed switches, one in the input line closely adjacent the input terminals, and one in the output line closely adjacent the output terminals. These magnetic reed switches are operated so that input devices to the instrument, such as thermocouples or the like, and output devices are connected to the instrument circuitry when the reed switches are in their unenergized position with the input and output test terminals being disconnected from the instrument, whereby the input devices, such as the thermocouple, and the output devices, such as external instruments, are disconnected from the instrument circuitry and the output devices when the reed switches are in their energized condition, thereby connecting the input and output test terminals to the electronic instrument. The reed switches are energized by the insertion of a key with a magnet thereon into one pair of the input or output test terminals. The magnet on the key will energize the reed switches which have been disposed sufficiently close to the key to be energized by the magnet thereon. The key also includes a pair of terminal pins which mate with the input or output terminals of the instrument and which are capable of receiving terminals from external devices therein.

BRIEF DESCRIPTION OF THE DRAWINGS

FIG. 4 is an enlarged view of the magnetic key extension plug; and

FIG. 5 is a schematic diagram of test terminal access to input and output circuits by way of magnetically operated reed switches in accordance with the present invention.

DESCRIPTION OF THE PREFERRED EMBODIMENT

Figure 1:
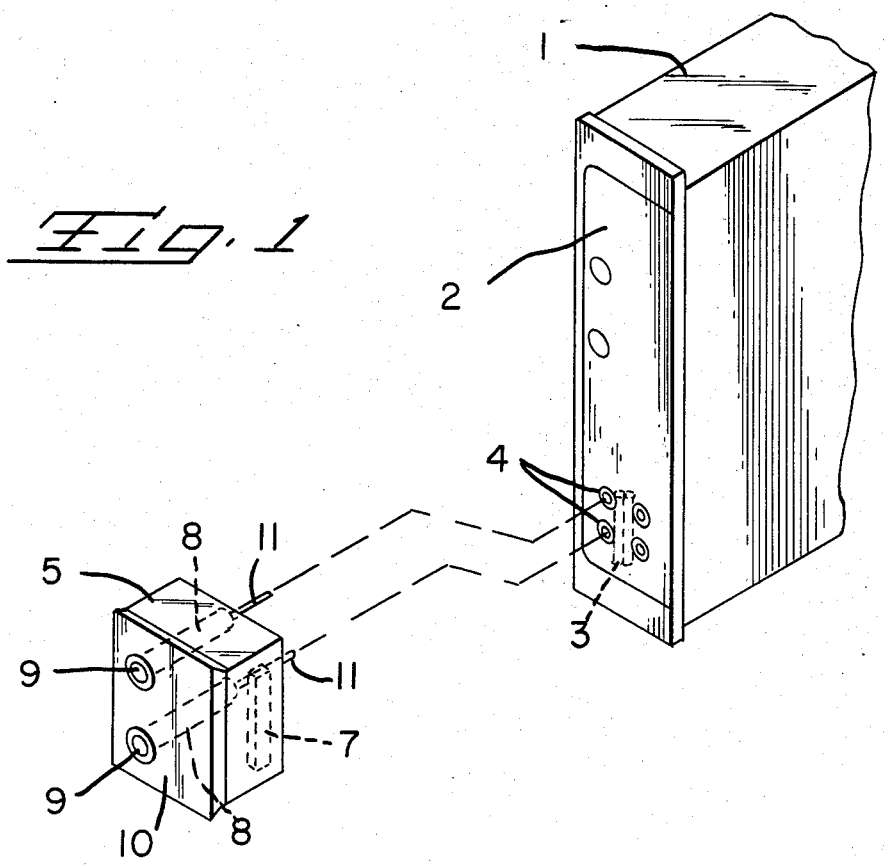
FIG. 1 is an exploded view of the front panel of an instrument and a magnetic key extension plug for insertion therein.
Figure 2:
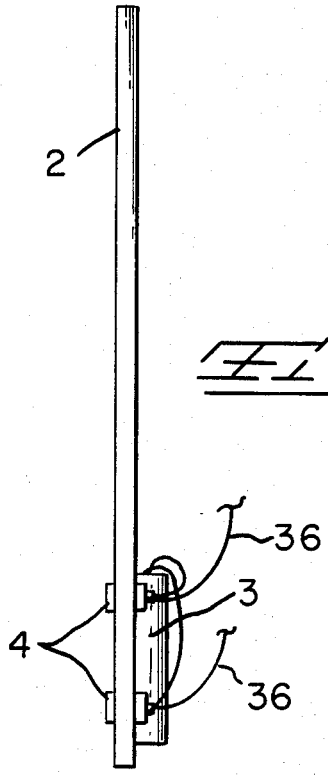
FIG. 2 is a side view of the front panel of the instrument of FIG. 1.
Figure 3:
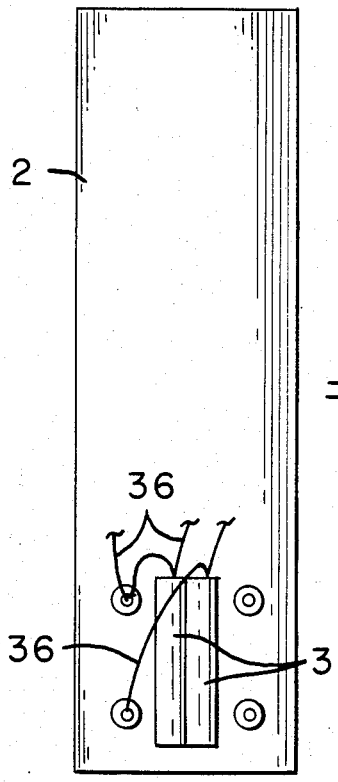
FIG. 3 is a rear view of the instrument front panel of the instrument in FIG. 1.

Referring now to FIGS. 1 to 3, there is shown an instrument 1 having a non-magnetic instrument front panel 2 shown with input and output terminals 4, the input terminals being shown to the left and the output terminals being shown to the right. A pair of hidden reed switches 3 are shown in phantom and are positioned behind the instrument front panel 2 and within the instrument 1 for reasons to be explained hereinbelow. Also shown is a magnetic key extension plug 5 which will be explained in greater detail hereinbelow. As is shown by the dashed lines, the plug 5 includes plug members 11 which enter at least one of the input and output terminal sets and control the reed switches 3 as will be explained hereinbelow. As can be seen from FIG. 2, the reed switches 3 are attached to the rear of the instrument front panel 2 and between the input and output terminals as can be seen from FIG. 3. Also shown are wires 36 extending to and from the reed switches 3. The reed switches 3 can be placed anywhere within the instrument 1 as long as they can be magnetically controlled by the magnet 7 of plug 5.

Referring now to FIG. 4, there is shown an enlarged view of the magnetic key extension plug 5. The plug 5 includes a plastic plug body 6 in which is disposed a magnet 7 which extends to the surface of the plug body 6 intimate with the front panel 2. Also shown are a pair of terminals 8 extending through the plug 5 and having one end thereof extending to the surface 10 of the plug remote from the instrument panel 2. The terminals 8 include bores 9 extending to the surface 10 remote from the instrument front panel 2 for receiving terminal pins from external devices. Also attached or integral with the terminals 8 are terminal pins 11 for insertion into the input and/or output terminals 4 as shown in FIG. 1.

Referring now to FIG. 5, there is shown a schematic circuit diagram as the circuit would be with the magnetic key extension plug 5 not inserted into the input and/or output terminals 4. Shown in FIG. 5 is a thermocouple 15 with its leads 16 and 17 secured within or external to the instrument 1 by hidden screw terminals 20 and 21. Leads 22 and 23 from the hidden screw terminals 20 and 21 are connected via a reed switch 24 through an optional plug-in connection 25 to the instrument electronics 26. As can be seen, with the reed switch 24 shown in the unenergized condition, i.e., with the magnetic key extension plug 5 not plugged into the terminals 4, the signal from the thermocouple 15 will go directly through the reed switch into the instrument electronics 26 and the input test terminal 27 will be open circuited relative to the instrument electronics. Similarly, at the output, the output lines to other instruments 30 and 31 are secured to hidden screw terminals 18 and 19 which are secured through an optional plug-in connection 32 along lines 33 and 34 and through reed switch 28 to the output of the instrument electronics 26.

The reed switch 28 is shown in its unenergized condition. The unenergized reed switch 28 places a short circuit across the output test terminals 35 and prevents the insertion of an unwanted signal current or voltage at those terminals. The diode 37, which is in parallel with the reed switch 28, maintains the output current when the switch 28 is energized but the user has failed to connect a tester to the terminals or the tester is of the wrong input impedance. A tester with the proper input impedance connected to terminals 35 will divert substantially all of the output current from instrument electronics 26 to its own input with, at most, a negligible amount of current passing through the diode.

The above described circuit arrangement of switch 28 can be altered in many ways as is apparent to those skilled in the art to achieve the same result or other desired results.

It can be seen from the above described circuitry that the magnetic key extension plug 5, in accordance with the present invention, disconnects all circuits at the input of the instrument electronics 26 with the exception of the test terminals 27 and by proper insertion thereof into the input terminals 4, output terminals 35 being short circuited and preventing insertion of an unwanted signal current or voltage when in the unenergized condition. In this way, it is unnecessary to move either the instrument 1 or remove any of the wiring to the instrument 1 when a test at the input and/or the output test terminals 4 is to take place.

Though the invention has been described with regard to a specific preferred embodiment thereof, many variations and modifications will immediately become apparent to those skilled in the art. It is therefore the intention that the appended claims be interpreted as broadly as possible in view of the prior art to include all such variations and modifications.

What is claimed is:

1. An on-line quick calibration system for an electrical instrument having (a) at least one signal path connected to the circuit of the instrument, (b) two further signal paths connectable to said at least one signal path, (c) magnetic reed switch means for normally connecting one of said further signal paths to said at least one signal path and simultaneously open circuiting the other of said further signal paths from the at least one signal path, and (d) control means including magnetic means associated with said magnetic reed switch means for altering the state of said switch means to disconnect said one of said further signal paths from said at least one signal path and to connect the other of said further signal paths to the at least one signal path, (e) each of said signal paths being provided by a pair of conductors.

2. An on-line quick calibration system as set forth in claim 1 wherein said control means includes a support carrying a magnet and terminal contact members which are connectable in said further signal paths, said terminal contact members also including means to receive further terminal contact members.

3. An on-line quick calibration system as set forth in claim 1 wherein said instrument includes a non-magnetic panel, said further signal paths extending to said panel, said switch means being mounted to said panel.

4. A system according to claim 1 wherein the at least one signal path is connected to the input of the instrument and the two further signal paths provide input paths respectively.

5. A system according to claim 4 wherein the instrument is provided with an external non-magnetic panel, (a) a terminal extending through said panel and connected to one of said circuit paths;

(b) a magnetic reed switch mounted closely adjacent said panel, disposed in one of said input paths to normally maintain said one of said paths open circuited and the other of said paths close circuited; and (c) control means for altering the state of said switch.

6. An on-line quick calibration system as set forth in claim 5 wherein said control means is securable to one of said input and output terminals on said panel.

7. An on-line quick calibration system as set forth in claim 5 wherein said control means comprises an electrically insulating, non-magnetic member, a magnet disposed in said member and terminal means extending through said member, said terminal means including means for receiving a further terminal.

8. A system according to claim 1 wherein the at least one signal path is connected to the output of the instrument and the two further paths provide respective output paths.

9. A system according to claim 8 further including a single signal path connected to the input of the instrument and two further signal paths connectable to said signal path connected to the input of the instrument.

* * * * *